US009027261B2

(12) United States Patent
Mazzarolo

(10) Patent No.: US 9,027,261 B2
(45) Date of Patent: May 12, 2015

(54) VENTILATED MOTORCYCLE BOOT

(75) Inventor: Giovanni Mazzarolo, Coste di Maser (IT)

(73) Assignee: Alpinestars Research SRL, Coste di Maser (Treviso) (IT)

( * ) Notice: Subject to any disclaimer, the term of this patent is extended or adjusted under 35 U.S.C. 154(b) by 27 days.

(21) Appl. No.: 13/055,033

(22) PCT Filed: Jul. 24, 2009

(86) PCT No.: PCT/EP2009/059594
§ 371 (c)(1),
(2), (4) Date: Jan. 20, 2011

(87) PCT Pub. No.: WO2010/010183
PCT Pub. Date: Jan. 28, 2010

(65) Prior Publication Data

US 2011/0126431 A1 Jun. 2, 2011
US 2012/0090196 A2 Apr. 19, 2012

(30) Foreign Application Priority Data

Jul. 25, 2008 (IT) ..... MI2008A1378

(51) Int. Cl.
*A43B 17/08* (2006.01)
*A43B 5/00* (2006.01)
*A43B 5/14* (2006.01)
*A43B 7/06* (2006.01)

(52) U.S. Cl.
CPC .. *A43B 5/145* (2013.01); *A43B 7/06* (2013.01)

(58) Field of Classification Search
CPC ..... A43B 7/06; A43B 7/08; A43B 7/082; A43B 7/084; A43B 5/145
USPC ..... 36/3 R, 3 A, 3 B, 131, 113, 147, 43, 44, 36/71, 29; 2/239
See application file for complete search history.

(56) References Cited

U.S. PATENT DOCUMENTS 1,213,941 A * 1/1917 Patrick ..... 36/3 A
1,476,127 A * 12/1923 Williams ..... 36/2 R
1,696,457 A * 12/1928 Shanahan ..... 36/3 B
1,885,327 A * 11/1932 Burnham ..... 264/257
(Continued)

FOREIGN PATENT DOCUMENTS

DE 29600910 3/1996
EP 1857000 A 11/2007
(Continued)

OTHER PUBLICATIONS

"PCT International Search Report dated Oct. 20, 2009 for PCT/EP2009/059594, from which the instant application is based," 3 pgs.
(Continued)

*Primary Examiner* — Jila M Mohandesi
*Assistant Examiner* — Katharine Gracz
(74) *Attorney, Agent, or Firm* — Fredrikson & Byron, P.A.

(57) ABSTRACT

A motorcycle boot comprises a sole or tread (22), a rigid shell (20) and an upper (52) associated with the rigid shell; the upper has furthermore a base insole (54) formed by a plurality of tubular channels (56) which extend over most of the bottom surface of the sole (54) and allow the air to pass at right angles to their axis; the shell has at the front an air intake communicating with the front end of the tubular channels.

15 Claims, 7 Drawing Sheets

(56) References Cited

U.S. PATENT DOCUMENTS

| | | | | | |
|---|---|---|---|---|---|
| 1,932,557 | A | | 10/1933 | Meucci | |
| 3,048,931 | A | | 8/1962 | Farinello | |
| 3,273,264 | A | * | 9/1966 | Farinello, Jr. | 36/3 A |
| 4,100,685 | A | * | 7/1978 | Dassler | 36/3 B |
| 4,587,749 | A | * | 5/1986 | Berlese | 36/131 |
| 4,693,021 | A | * | 9/1987 | Mazzarolo | 36/131 |
| 4,888,887 | A | | 12/1989 | Solow | |
| 5,171,033 | A | * | 12/1992 | Olson et al. | 280/11.202 |
| D339,672 | S | * | 9/1993 | Olson | D2/961 |
| 5,331,752 | A | * | 7/1994 | Johnson et al. | 36/115 |
| 5,342,070 | A | * | 8/1994 | Miller et al. | 280/11.231 |
| 5,369,895 | A | | 12/1994 | Hammerschmidt | |
| 5,400,526 | A | * | 3/1995 | Sessa | 36/3 B |
| 5,596,820 | A | * | 1/1997 | Edauw et al. | 36/115 |
| 5,738,937 | A | * | 4/1998 | Baychar | 428/316.6 |
| 5,746,013 | A | | 5/1998 | Fay, Sr. | |
| 5,797,610 | A | * | 8/1998 | Grande et al. | 280/11.202 |
| 5,878,513 | A | * | 3/1999 | Annovi et al. | 36/115 |
| 5,955,172 | A | * | 9/1999 | Hurten | 428/116 |
| 6,041,518 | A | | 3/2000 | Polycarpe | |
| 6,196,556 | B1 | * | 3/2001 | Bonaventure et al. | 280/11.202 |
| 6,233,845 | B1 | * | 5/2001 | Belli | 36/3 A |
| 6,280,815 | B1 | | 8/2001 | Ersfeld | |
| 6,401,364 | B1 | * | 6/2002 | Burt | 36/3 A |
| 6,408,540 | B1 | | 6/2002 | Dekalb et al. | |
| 6,732,455 | B2 | * | 5/2004 | Bordin et al. | 36/89 |
| 6,766,539 | B1 | * | 7/2004 | Huber | 2/239 |
| 6,826,853 | B1 | * | 12/2004 | Zanatta | 36/131 |
| 6,874,252 | B2 | * | 4/2005 | Nakano | 36/8.1 |
| 6,993,858 | B2 | * | 2/2006 | Seamans | 36/3 A |
| 7,024,803 | B2 | * | 4/2006 | Basso | 36/3 B |
| D520,219 | S | * | 5/2006 | Mazzarolo | D2/910 |
| D547,032 | S | * | 7/2007 | Mazzarolo | D2/911 |
| 7,251,907 | B1 | * | 8/2007 | Bondarchuk | 36/3 B |
| 7,337,557 | B2 | | 3/2008 | Miyata | |
| 7,363,765 | B2 | * | 4/2008 | Szczesuil et al. | 62/3.5 |
| 7,437,838 | B2 | * | 10/2008 | Nau | 36/102 |
| 7,441,351 | B2 | * | 10/2008 | Clark et al. | 36/138 |
| 7,543,398 | B2 | * | 6/2009 | Hsaio et al. | 36/55 |
| 7,546,697 | B2 | * | 6/2009 | Polegato Moretti | 36/30 R |
| 7,549,238 | B2 | * | 6/2009 | Patakos | 36/100 |
| 7,610,694 | B2 | * | 11/2009 | De Giacomi | 36/3 R |
| 7,673,399 | B2 | * | 3/2010 | Garcia-Perez Aradros | 36/97 |
| 7,913,421 | B2 | * | 3/2011 | Malenotti | 36/3 B |
| 7,958,655 | B2 | * | 6/2011 | Munns | 36/131 |
| 8,074,375 | B2 | * | 12/2011 | Longuet | 36/3 R |
| 8,127,465 | B2 | * | 3/2012 | Byrne et al. | 36/3 R |
| 8,146,266 | B2 | * | 4/2012 | Vattes et al. | 36/3 A |
| 8,151,484 | B2 | * | 4/2012 | Hubner | 36/4 |
| 2005/0120591 | A1 | * | 6/2005 | Andrew | 36/29 |
| 2007/0074424 | A1 | | 4/2007 | Lin | |
| 2009/0107013 | A1 | * | 4/2009 | Berger et al. | 36/3 B |
| 2009/0293318 | A1 | * | 12/2009 | Garneau et al. | 36/131 |
| 2010/0071234 | A1 | * | 3/2010 | Basso | 36/3 B |

FOREIGN PATENT DOCUMENTS

| | | | |
|---|---|---|---|
| FR | 861788 | | 2/1941 |
| FR | 2424716 | A | 11/1979 |
| FR | 2821758 | A | 9/2002 |
| WO | 9835572 | A | 8/1998 |

OTHER PUBLICATIONS

PCT International Search Report dated Nov. 26, 2009 for PCT/IB2009/053576, 3 pages.

PCT International Preliminary Report on Patentability dated Jun. 10, 2010 for PCT/IB2009/053576, 6 pages.

U.S. Appl. No. 13/058,406 Office Action mailed Jul. 31, 2013, 10 pages.

U.S. Appl. No. 13/058,406 Office Action mailed Apr. 10, 2014, 12 pages.

U.S. Appl. No. 13/058,406 Amendment filed Dec. 31, 2013, 12 pages.

U.S. Appl. No. 13/058,406 Office Action response filed Aug. 11, 2014, 9 pages.

U.S. Appl. No. 13/058,406, Office Action mailed Dec. 22, 2014, 14 pages.

* cited by examiner

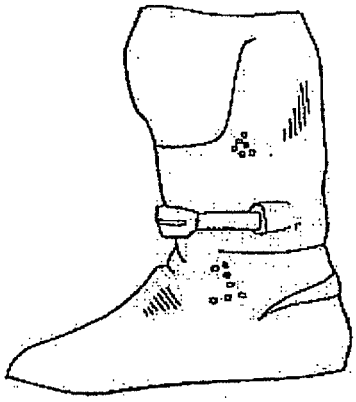
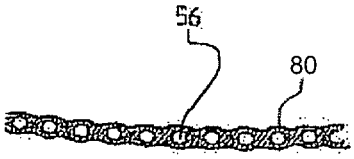
Fig. 8
Fig. 7
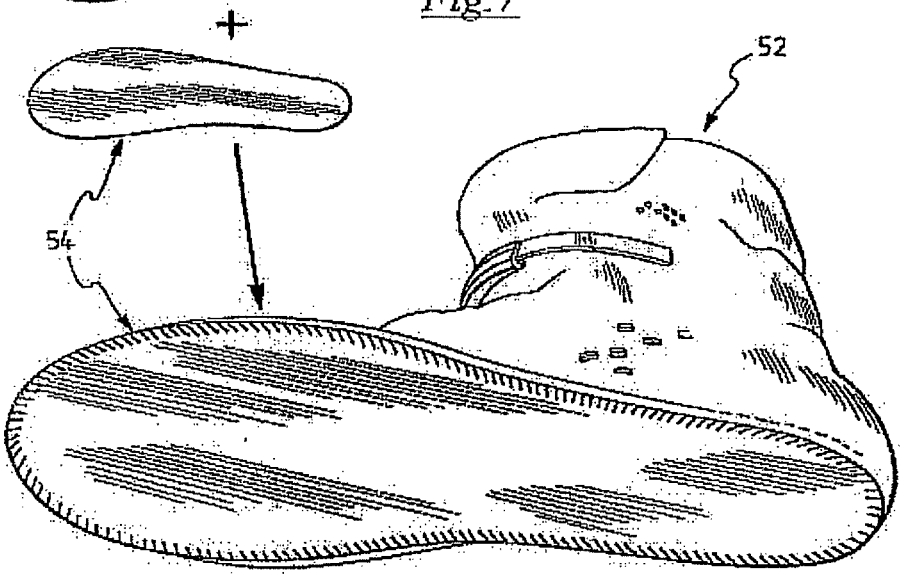
Fig. 6

VENTILATED MOTORCYCLE BOOT

RELATED APPLICATIONS

This application is a US 371 national stage entry of International Application No. PCT/EP2009/059594, filed Jul. 24, 2009, which claims priority to Italian Application No. MI2008A001378 filed Jul. 25, 2008, the teachings of which are incorporated herein by reference.

FIELD OF THE INVENTION

The present invention relates to a motorcycle boot.

BACKGROUND

It is known that one of the problems associated with the use of boots, in particular during motorcycle races, is that of overheating of the foot enclosed inside the boot, this representing a major problem for the user.

More generally, the problem of foot ventilation has been the subject of numerous studies and many solutions are known where holes are provided mainly in the tread of the boot, with special arrangements to prevent the entry of water in the event of rain.

Other solutions are also known, for example in the case of boots for in-line skates, where the shoe upper is provided with ventilation openings which are protected by air-permeable material (for example in the form of a fine mesh) so that, during use of the shoe, the air which enters through these ventilation openings or windows passes over the front part of the foot.

SUMMARY OF CERTAIN EMBODIMENTS OF THE INVENTION

However, in the specific case of motorcycle boots, it is required to provide a substantial flow of cooling air and ensure that this flow passes over the entire bottom surface of the foot, without being limited to the front portion.

This result has not yet been achieved with the solutions proposed by the prior art and therefore constitutes the main technical problem and therefore the object of the present invention.

A more specific object of the present invention is to provide a motorcycle boot of the type suitable for the specific discipline known as motocross, provided with means for cooling the sole of the user's foot.

This object, together with others, is achieved by means of a motorcycle boot which has the characteristic features defined in Claim 1.

The main advantage achieved with the present invention is that of ensuring truly effective cooling and ventilation of the entire foot sole without negatively affecting the structure of the boot.

BRIEF DESCRIPTIONS OF DRAWINGS

The features and advantages of the present invention will emerge more clearly from the description which follows of a preferred embodiment, provided with reference to the accompanying drawings in which:

FIG. 6 shows an axonometric view of the upper of the boot;

FIG. 7 shows an exploded view of the two components of the upper according to FIG. 6;

FIG. 8 shows a cross-section through a detail of the insole of the upper of the boot;

DETAILED DESCRIPTION OF EMBODIMENTS OF THE INVENTION

Figures 1, 2:
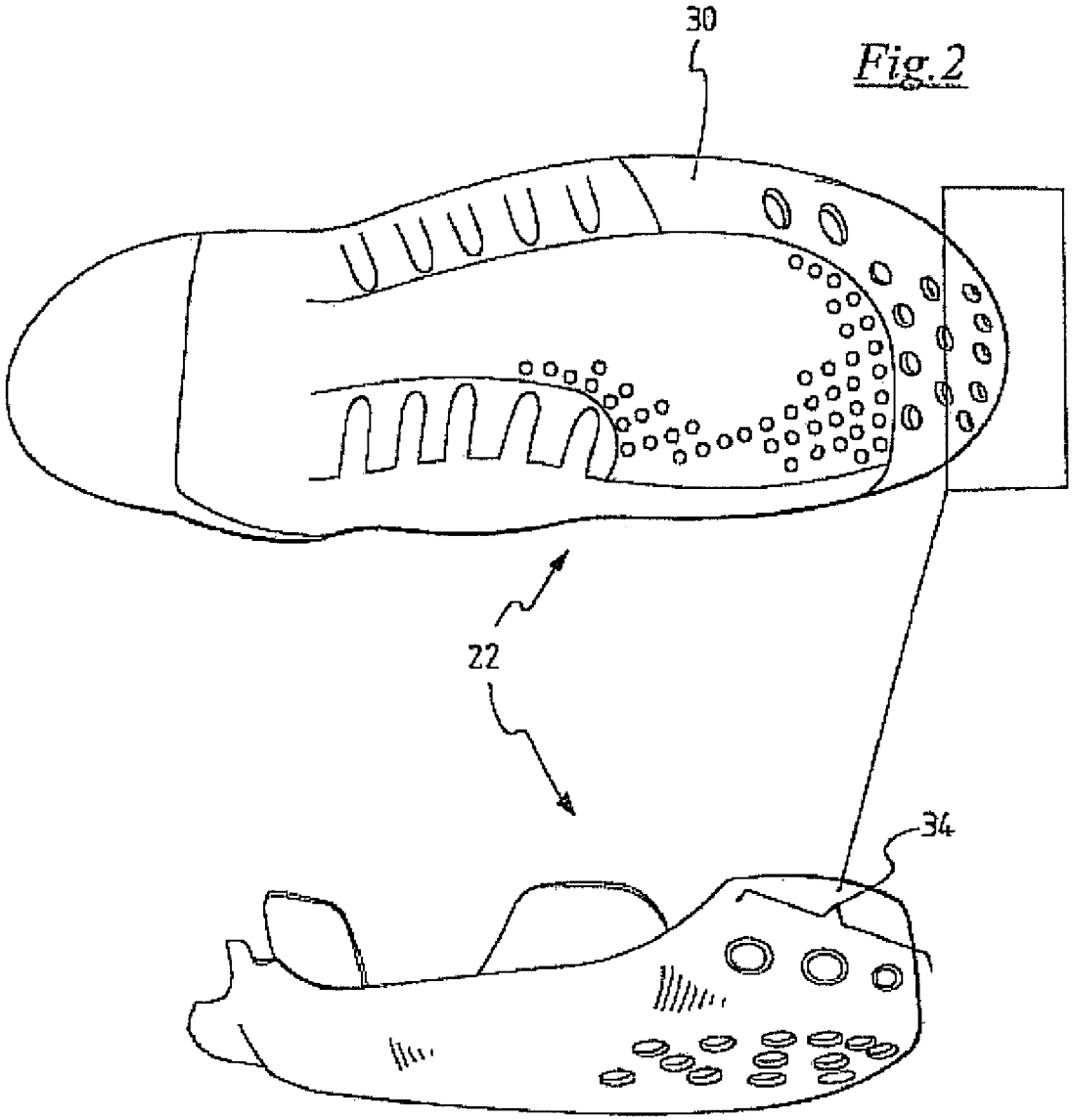
FIGS. 1 and 2 are a side elevation view and plan view from below, respectively, of the boot sole or tread.

With reference to the drawings, the boot to which the present invention relates has, by way of main components, a shell 20, a sole or tread 22, an inner bootie 24 and an upper 52.

Considering firstly the tread 22, this comprises a base 30, provided with the molded patterns usually found in this type of boot, and a raised perimetral edge 32 which has at the front, namely at the toe end of the boot, three openings 34 which perform the function explained below when the tread is joined to the shell 20.

In particular, the perimetral edge is joined externally to the bottom edge portion of the shell, forming a reinforced strip.

Figure 3:
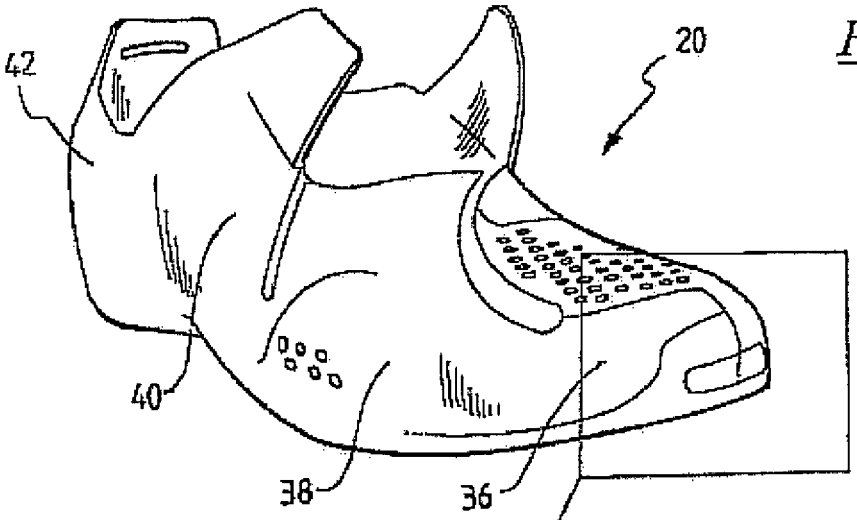
FIG. 3 shows an axonometric view of the shell of the boot.
Figure 4:
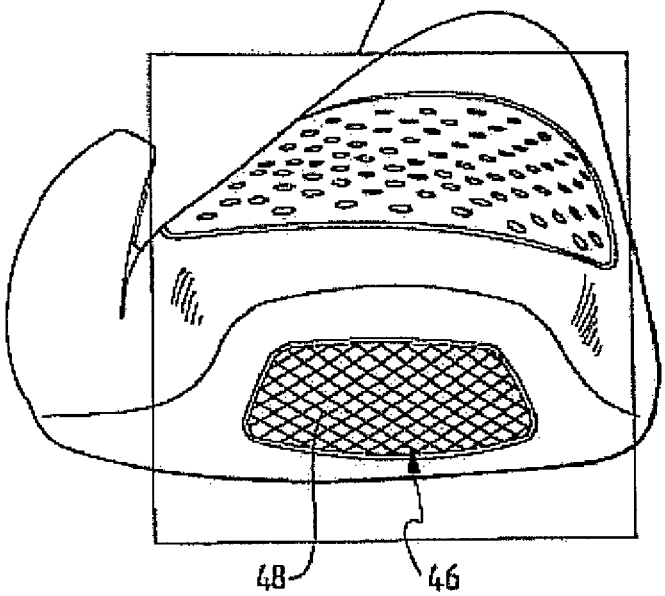
FIGS. 4 and 5 are a front view and rear view, respectively, of the shell according to FIG. 3.
Figure 5:
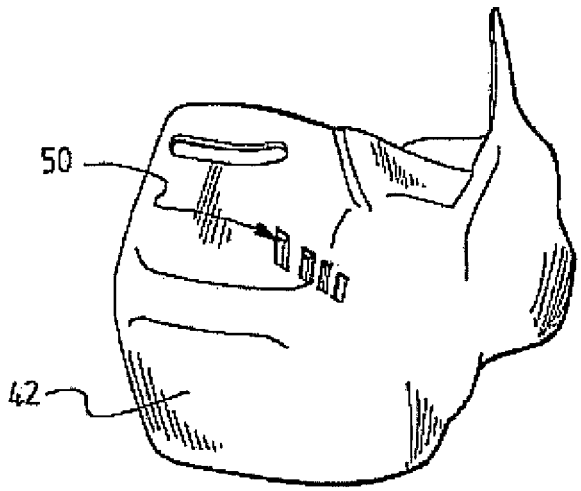

If we now consider the shell 20, with reference to FIGS. 3, 4 and 5, this consists of a rigid casing, partly in the form of a shoe, namely comprising a toe piece 36, a front-upper portion 38, which has an opening substantially aligned with the axial mid-plane of the boot, the front portion being extended in the form of two side cheeks 40 and terminating at the rear in a spur-like element 42.

As shown in FIG. 4, the toe end, namely the front end, of the shell 20 is provided with an opening 46 which is closed by means of a metal mesh 48 so that, when the tread is fixed to the shell so that its raised edge 32 surrounds and embraces the bottom edge of the shell 20, the three openings 34 are arranged so as to coincide with the opening 46, forming an air intake.

The shell 20 also has at the rear similar openings 50 which are protected by a mesh which acts as an outlet for the cooling air entering through the air intake described above.

If we now consider FIGS. 6 and 7, this shows the leg-piece upper of the boot comprising an actual upper, denoted overall by the reference number 52, and an insole 54 which in the specific case consists of a layer of material shown in cross-section in FIG. 8 and which is commercially available under the name of Air Spring.

As can be seen from FIG. 8, this material consists of two layers or double layer 80 of substantially rigid polyester yarn fabric, between which tubular channels 56 arranged alongside and parallel to each other are defined. As further shown in FIG. 8, neighboring channels 56 of the double layer 80 are adjoined so as to abut or be directly adjacent each other in side-to-side manner along their longitudinal extents.

Since the two layers or double layer 80 of fabric are perfectly permeable, the channels 56, when acted on by an air flow passing along their length, distribute the said air at right angles to their longitudinal axes.

In the embodiment according to the present invention, the material forming the insole 54 is arranged with the tubular channels 56 parallel to the longitudinal axis of the boot.

Figure 11:
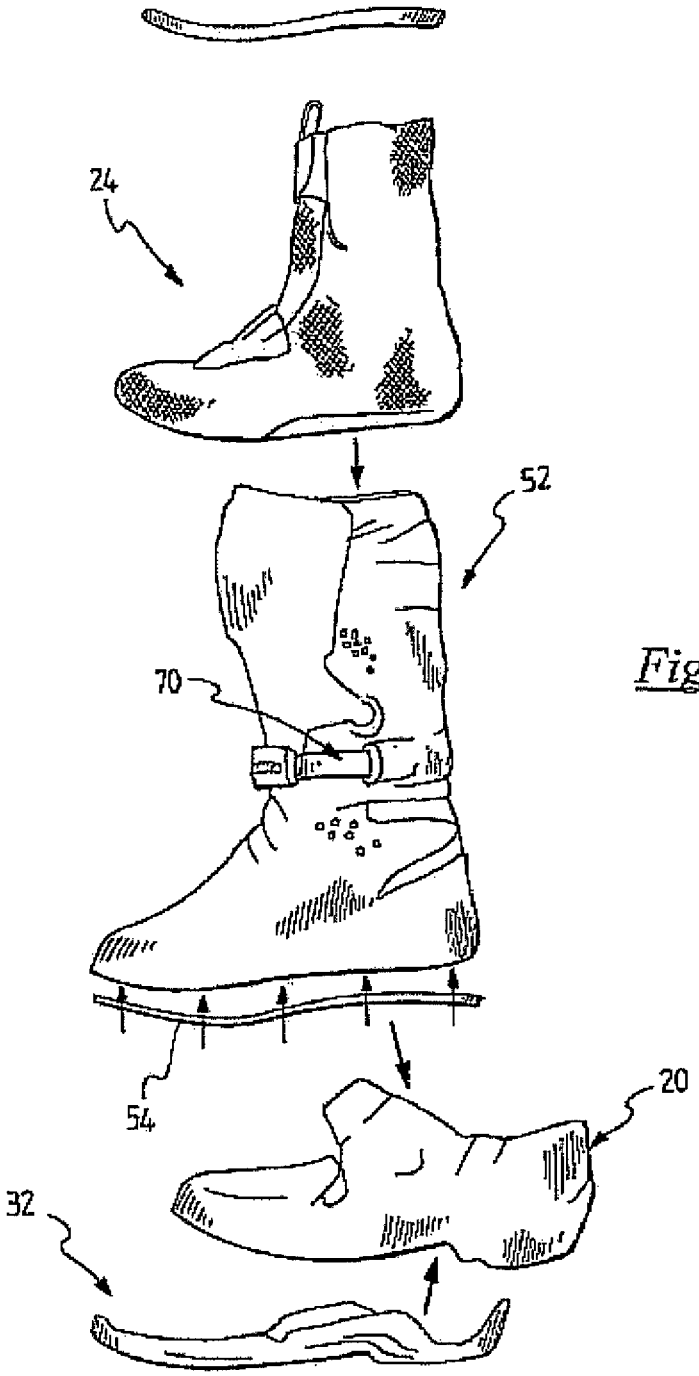
FIG. 11 shows an exploded view of the entire boot.

From FIG. 11, it can be seen how the upper of the boot is also provided with fastening means 70 for closing and tightening around the user's foot. Since these consist of parts which are conventional in this type of boot they are not described in further detail.

Figure 9:
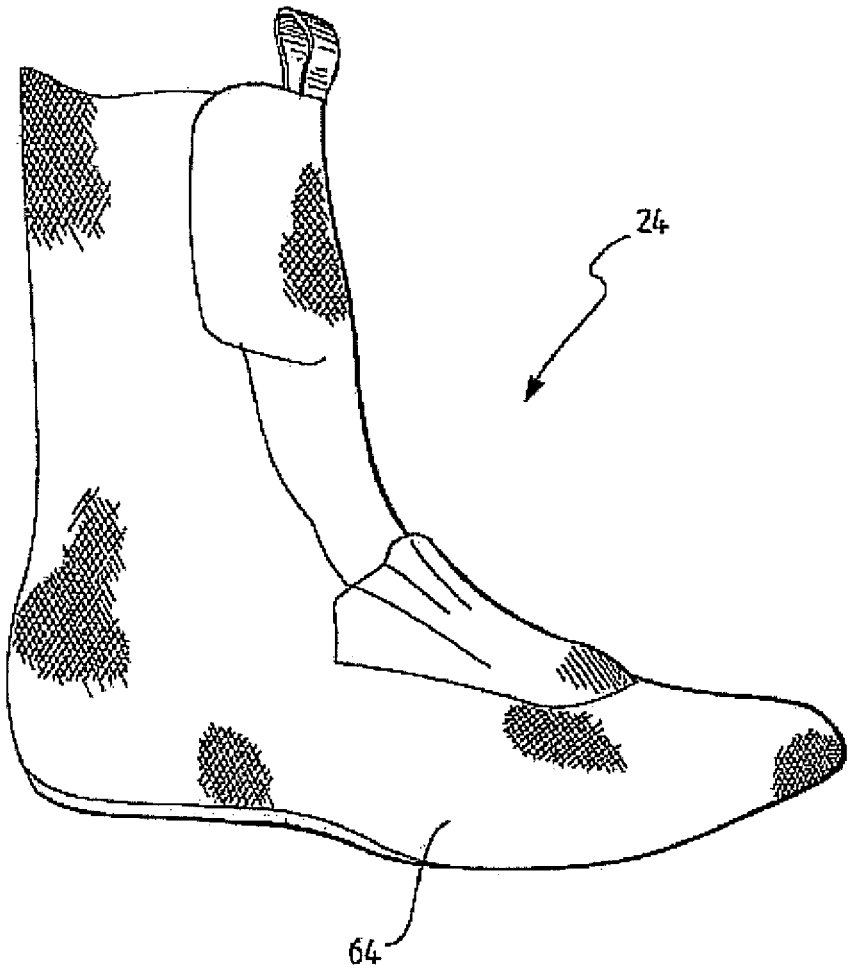
FIG. 9 shows a side view of the inner bootie of the boot.

The upper 52 houses internally what may be called an inner bootie 24 (FIGS. 9 and 10) which is composed of a soft part 64.

This is similar to a shaped stocking which matches the shape of the foot and is made of breathable fabric which allows the air to pass through freely.

The bootie 24 finally houses internally in a removable manner an insole made of the same material referred to above as Air Spring, the sole of the user's foot resting directly on said material.

Figure 10:
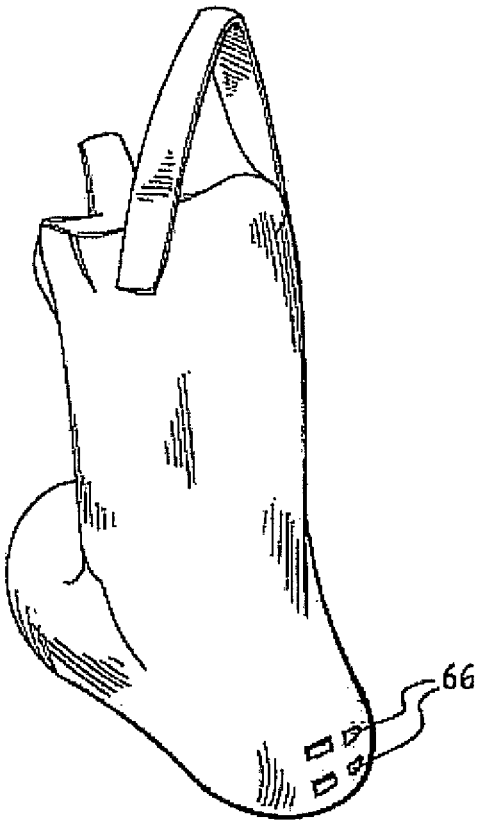
FIG. 10 shows a rear view of the inner bootie according to FIG. 9.
Figure 12:
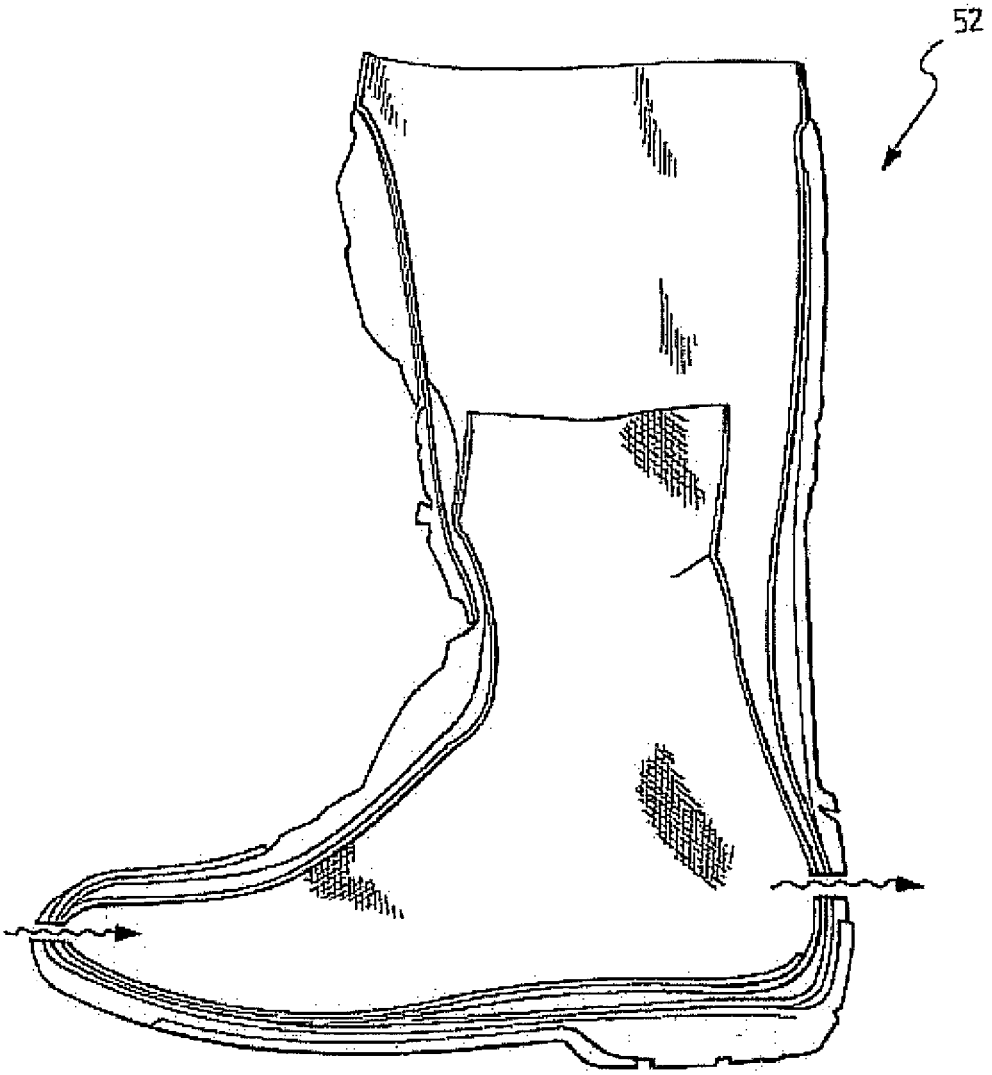
FIG. 12 shows a cross-sectional view of the boot assembled.

From FIG. 10 it can be seen how the bootie has at the rear holes 66 for letting out the cooling air after it has passed over the sole and part of the upper surface of the foot, said holes being arranged so as to correspond to the openings formed in the shell for this function. With reference to FIG. 12, the rear holes 66 are defined as openings that fluidly connect interior of the bootie with exterior of the rigid shell at the rear of the boot.

The structure of the boot according to the present invention may be appreciated more fully from FIGS. 11 and 12.

Cooling and ventilation of the user's foot begins as soon as the rider mounts a motorcycle and starts a race.

The vehicle movement causes the entry of air through the air intake formed by the three front openings in the tread and the opening formed in the shell The metal mesh prevents the entry of foreign bodies, such as grit.

The incoming air stream enters into the front ends of the tubular channels in the bottom insole of the upper, passing over the entire bottom surface of the upper.

At the same time this air stream is transferred at right angles to the overlying base of the inner bootie and via the breathable fabric of the bootie passes to the internal insole of the bootie, the tubular channels of which complete distribution of the air over practically all the bottom surface of the user's foot.

The air then passes out through the rear openings formed in the bootie, the opening formed in the upper and finally the screened openings formed at the rear in the shell.

In this way the problem of cooling and ventilation of the user's foot is solved, preventing, especially in sporting disciplines such as motocross, overheating of the foot, which occurs in particular during difficult and long races.

It is understood that conceptually and structurally equivalent variants are possible and may be envisaged, in particular in order to adapt the invention to boot designs which differ in terms of the conventional components.

In other words, it is possible to envisage adopting in other types of motocross boots the underlying principle of the present invention consisting in providing a front air intake, preferably screened by a protection system, a plurality of tubular channels which are aligned substantially with the longitudinal axis of the boot and able to distribute the air at right angles to their axis so that it reaches the sole of the user's foot.

The invention claimed is:

1. Motorcycle boot comprising a tread, a rigid shell to which said tread is fixed, and an upper associated with said rigid shell, said upper having a portion configured to wrap around a user's leg and joined with a base insole formed by a plurality of tubular channels, the tubular channels extending over most of a lower surface of the base insole and suitable for allowing passage of air along longitudinal axes of said tubular channels and at right angles to the longitudinal axes of said tubular channels, said rigid shell having a front or toe end that is positionable forward of a user's toes and that forms an air intake positioned forward of the tubular channels such that air flowing at said front end of rigid shell enters the air intake and then enters fore ends of said tubular channels, said rigid shell further comprising at least one rear air outlet opening communicating with said air intake via said tubular channels, said tubular channels being formed by a double layer of rigid fabric and being parallel to each other and oriented parallel to a longitudinal axis of the boot, neighboring ones of the tubular channels being directly adjacent each other in side-to-side manner, said rigid fabric being permeable such that the passage of air at right angles to the longitudinal axes of said tubular channels occurs continuously through an entire span of each of the channels.

2. The motorcycle boot according to claim 1, wherein said air intake comprises an opening protected by a mesh formed in the toe end of said rigid shell.

3. The motorcycle boot according to claim 2, wherein a raised edge is provided at a front of said tread with openings which are arranged so as to further form air intake.

4. The motorcycle boot according to claim 1, further comprising an inner bootie adapted for insertion into said upper and together therewith into said shell, said inner bootie being made of breathable fabric.

5. The motorcycle boot according to claim 4, wherein a layer of said rigid fabric is provided in the form of an insole in said inner bootie.

6. The motorcycle boot according to claim 5, wherein a rear part of said inner bootie is provided with cooling air outlet holes to correspond with the at least one rear air outlet.

7. The motorcycle boot of claim 1, wherein the rigid fabric comprises polyester yarn.

8. The motorcycle boot according to claim 4, wherein a rear part of said inner bootie is provided with cooling air outlet holes to correspond with the at least one rear outlet opening.

9. The motorcycle boot according to claim 4, wherein a rear part of said inner bootie is provided with cooling air outlet holes to correspond with at least one rear outlet opening provided in the shell, said at least one rear air outlet opening communicating with said air intake.

10. The motorcycle boot of claim 5, wherein the rigid fabric comprises polyester yarn.

11. The motorcycle boot according to claim 1, further comprising an inner bootie adapted for insertion into said upper and said shell, said inner bootie having outlet holes, the holes defined as openings that correspond with the at least one rear air outlet opening in the rigid shell for expelling air rearward from the bootie once such air has passed over the insole and part of an upper surface of a user's foot.

12. The motorcycle boot according to claim 1, wherein the neighboring ones of the tubular channels are directly adjacent each other along longitudinal extents of the tubular channels.

13. The motorcycle boot according to claim 1, wherein the at least one rear outlet opening is rearward of rear ends of the tubular channels.

14. The motorcycle boot according to claim 1, wherein the upper is configured to wrap around a user's calf.

15. The motorcycle boot according to claim 1, wherein the neighboring ones of the tubular channels are directly adjacent each other in side-to-side manner without spacing therebetween.

* * * * *